US010858229B1

(12) United States Patent
Tucker

(10) Patent No.: US 10,858,229 B1
(45) Date of Patent: Dec. 8, 2020

(54) FORKLIFT LOAD-LIFTING DEVICE

(71) Applicant: Alvin Tucker, Hephzibah, GA (US)

(72) Inventor: Alvin Tucker, Hephzibah, GA (US)

( * ) Notice: Subject to any disclaimer, the term of this patent is extended or adjusted under 35 U.S.C. 154(b) by 144 days.

(21) Appl. No.: 16/242,162

(22) Filed: Jan. 8, 2019

(51) Int. Cl.
*B66F 9/18* (2006.01)
*B66C 1/14* (2006.01)

(52) U.S. Cl.
CPC . *B66F 9/18* (2013.01); *B66C 1/14* (2013.01)

(58) Field of Classification Search
CPC ..... B66C 1/14; B66C 1/12; B66F 9/12; B66F 9/18
See application file for complete search history.

(56) References Cited

U.S. PATENT DOCUMENTS

| | | | | | |
|---|---|---|---|---|---|
| 2,362,991 | A * | 11/1944 | Dahl | B64F 1/22 | 414/427 |
| 2,696,317 | A | 12/1954 | Toffolon | | |
| 3,007,592 | A * | 11/1961 | Adams | B66F 9/061 | 414/607 |
| 3,207,347 | A | 9/1965 | Ehrlich | | |
| 3,587,893 | A * | 6/1971 | Laken | B66F 9/061 | 414/607 |
| 3,788,492 | A * | 1/1974 | Kraft | B66F 9/061 | 212/180 |
| 3,930,585 | A * | 1/1976 | Lynch | B65G 59/02 | 414/607 |
| 4,073,175 | A | 2/1978 | Seamon | | |
| 4,579,504 | A | 4/1986 | Lemme | | |
| 5,642,979 | A * | 7/1997 | Cullen | B21C 47/242 | 414/607 |
| 6,371,543 | B1 | 4/2002 | Fujikawa | | |
| D601,325 | S | 9/2009 | Tanaka | | |
| 9,371,685 | B2 * | 6/2016 | Cooper | B60J 5/108 | |
| 10,280,055 | B2 * | 5/2019 | Menduni | B66F 9/18 | |
| 10,556,783 | B2 * | 2/2020 | Ivey | B66F 9/12 | |

FOREIGN PATENT DOCUMENTS

WO 2010131956 11/2010

OTHER PUBLICATIONS

Kenco ForkLift adapter manual, available at https://kenco.com/wp-content/uploads/2016/08/Forklift-Adapter-Manual-8.26.16.pdf (Year: 2017).*

Wayback machine showing Kenco ForkLift adapter manual as of 2017, https://web.archive.org/web/20170329065443/http://kenco.com/wp-content/uploads/2016/08/Forklift-Adapter-Manual-8.26.16.pdf (Year: 2017).*

Kenco Forklift Adapter info sheet, https://kenco.com/wp-content/uploads/2017/10/Forklift-Information-Sheet-09-12-17.pdf (Year: 2017).*

Kenco Forklift Adapter dimension sheet, https://kenco.com/wp-content/uploads/2016/03/Forklift-Adapter-Dimension-Sheet2.pdf (Year: 2016).*

* cited by examiner

*Primary Examiner* — Mark C Hageman

(57) ABSTRACT

The forklift load-lifting device is an accessory for a forklift that adapts the forklift to lift payload material. The forklift load-lifting device may be raised and lowered by forks of the forklift using a left sleeve and a right sleeve. A front support and a rear support may separate the left sleeve and the right sleeve by a fixed distance that corresponds to the distance between the forks of the forklift. A chain may be coupled to the front support. The payload material may be raised and lowered by a chain and a hook as the forklift load-lifting device is raised and lowered. As non-limiting examples, the payload material may comprise pre-cast concrete or stone.

13 Claims, 4 Drawing Sheets

FORKLIFT LOAD-LIFTING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of cargo handling equipment, more specifically, a forklift load-lifting device.

SUMMARY OF INVENTION

The forklift load-lifting device is an accessory for a forklift that adapts the forklift to lift payload material. The forklift load-lifting device may be raised and lowered by forks of the forklift using a left sleeve and a right sleeve. A front support and a rear support may separate the left sleeve and the right sleeve by a fixed distance that corresponds to the distance between the forks of the forklift. A chain may be coupled to the front support. The payload material may be raised and lowered by a chain and a hook as the forklift load-lifting device is raised and lowered. As non-limiting examples, the payload material may comprise pre-cast concrete or stone.

An object of the invention is to provide an accessory for a forklift that enables the forklift to lift payload material such as precast concrete and stone.

Another object of the invention is to slide the invention onto the forks of the forklift using a left sleeve and a right sleeve.

A further object of the invention is to provide a front support and a right support to separate the left sleeve and the right sleeve.

Yet another object of the invention is to provide a chain and hook coupled to the front support and a safety latch coupled to the rear support.

These together with additional objects, features and advantages of the forklift load-lifting device will be readily apparent to those of ordinary skill in the art upon reading the following detailed description of the presently preferred, but nonetheless illustrative, embodiments when taken in conjunction with the accompanying drawings.

In this respect, before explaining the current embodiments of the forklift load-lifting device in detail, it is to be understood that the forklift load-lifting device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the forklift load-lifting device.

It is therefore important that the claims be regarded as including such equivalent construction insofar as they do not depart from the spirit and scope of the forklift load-lifting device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
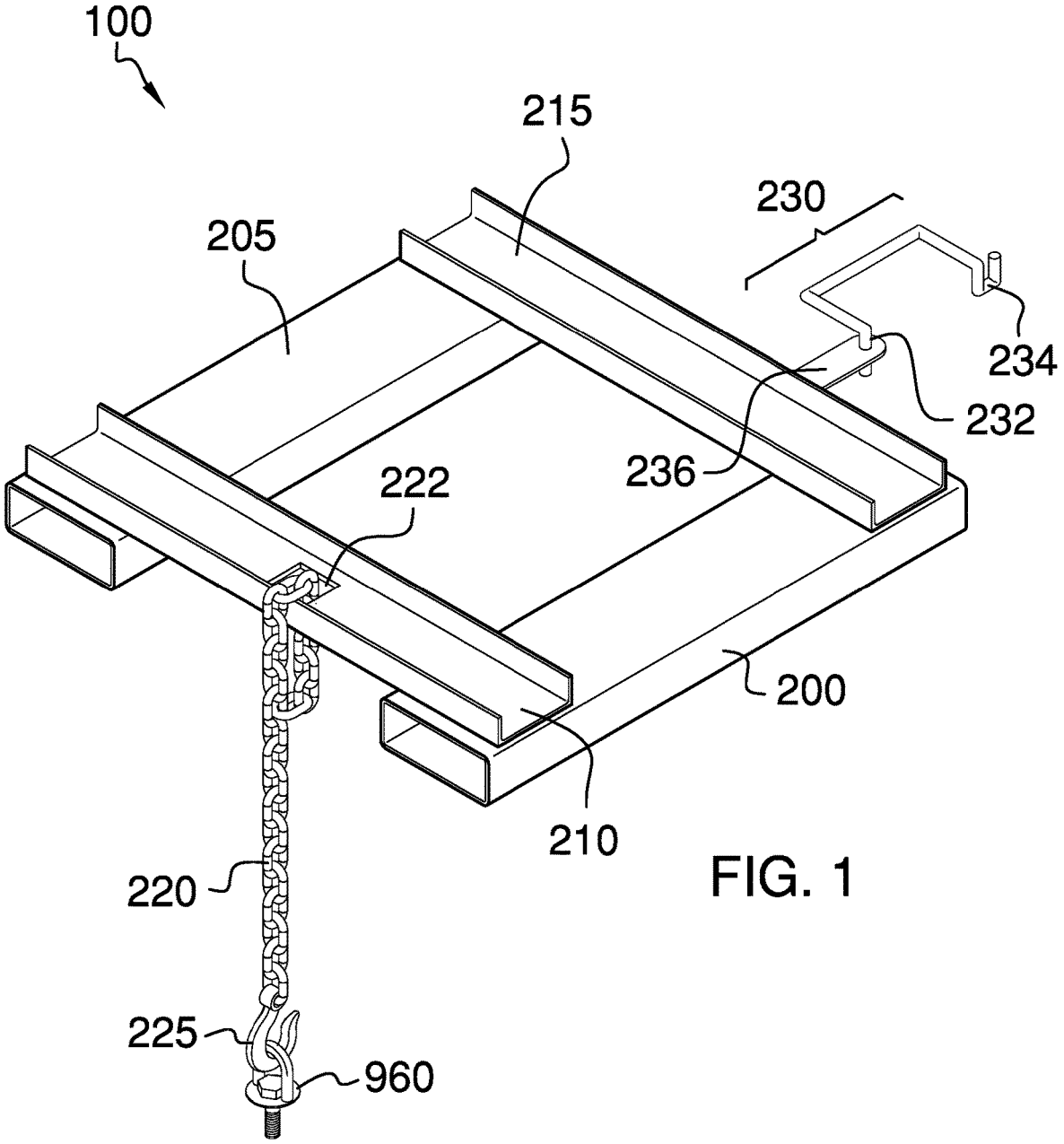
FIG. 1 is a perspective view of an embodiment of the disclosure.
Figure 2:
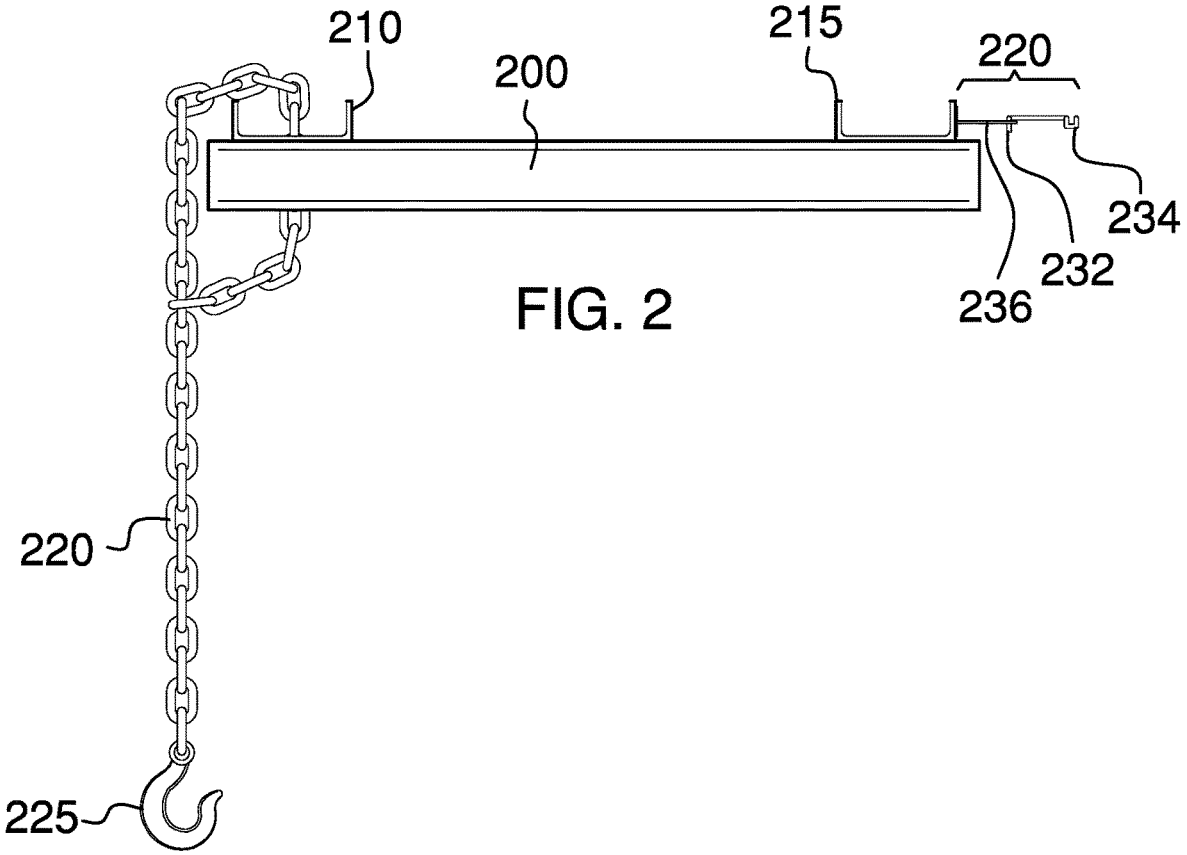
FIG. 2 is a side view of an embodiment of the disclosure.
Figure 3:
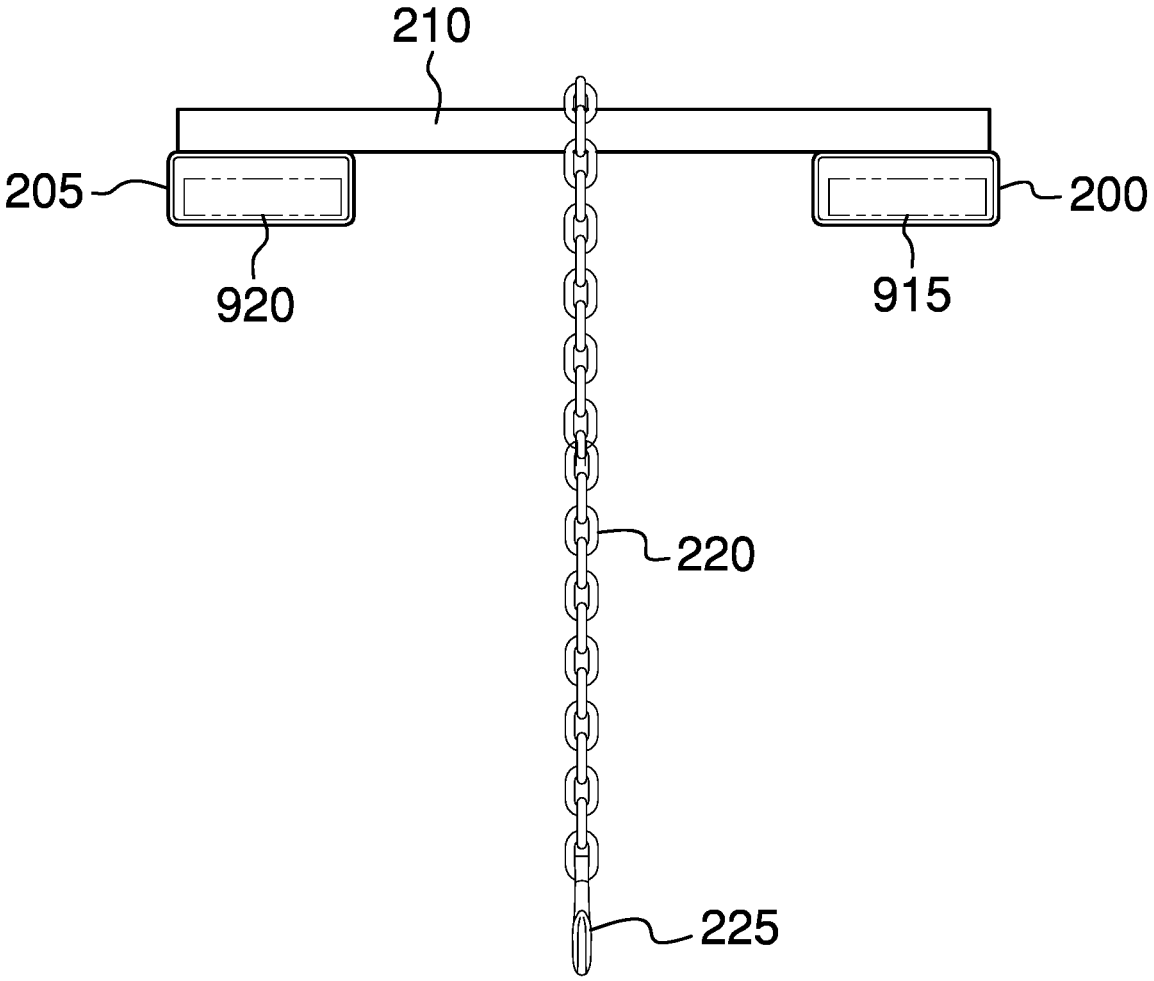
FIG. 3 is a front view of an embodiment of the disclosure.
Figure 4:
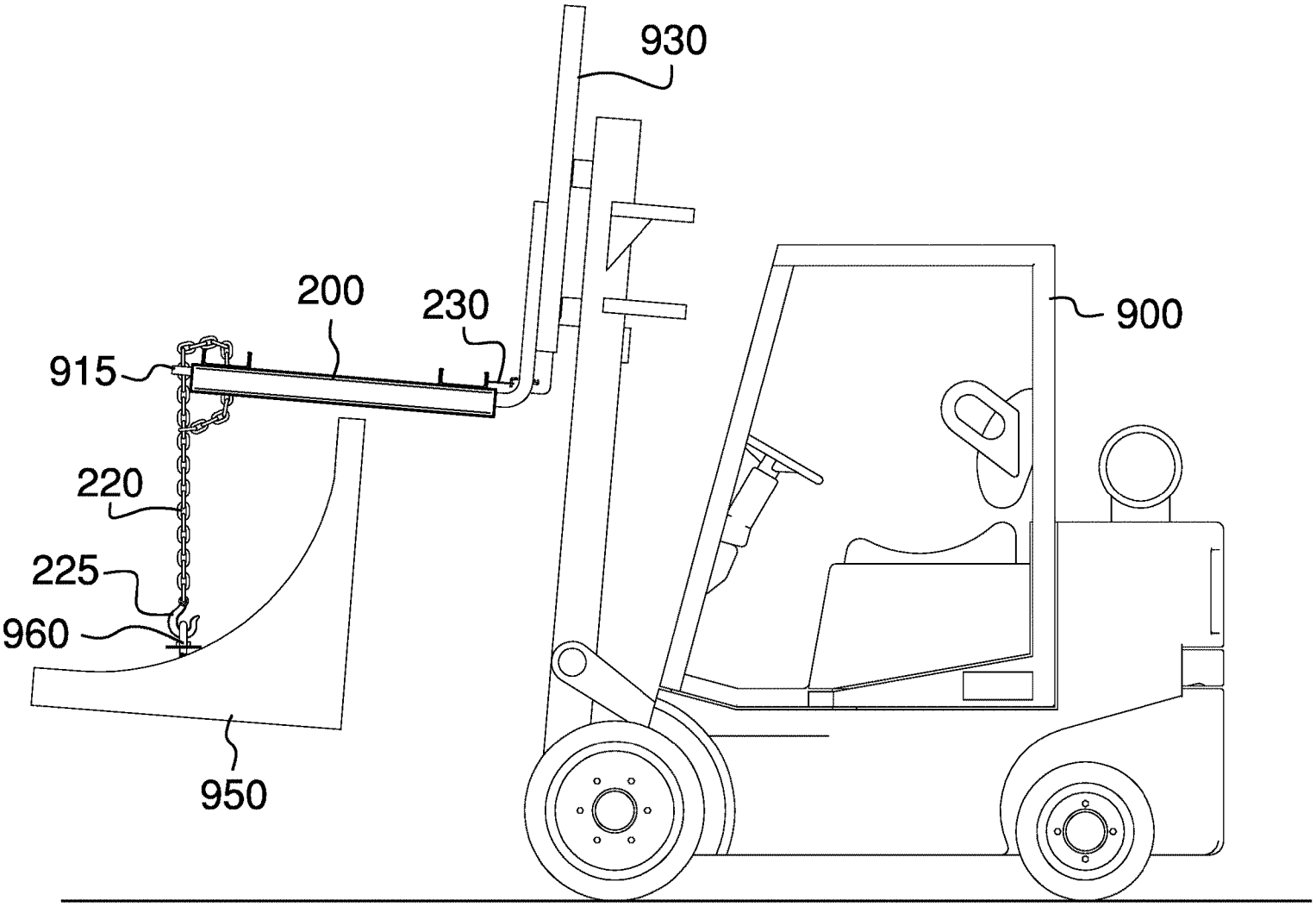
FIG. 4 is an in-use of an embodiment of the disclosure illustrating a forklift lifting payload material.

Detailed reference will now be made to a first potential embodiment of the disclosure, which is illustrated in FIGS. 1 through 4.

The forklift load-lifting device 100 (hereinafter invention) comprises a left sleeve 200, a right sleeve 205, a front cross support 210, a rear cross support 215, a chain 220, and a hook 225. The invention 100 may be an accessory for a forklift 900 that adapts the forklift 900 to lift a payload material 950. The invention 100 may be raised and lowered by forks of the forklift 900 using the left sleeve 200 and the right sleeve 205. The payload material 950 may be raised and lowered by the chain 220 and the hook 225 as the invention 100 is raised and lowered. As non-limiting examples, the payload material 950 may comprise pre-cast concrete or stone.

The left sleeve 200 may be a straight, hollow tube. The left sleeve 200 may slide onto a left fork 915 of the forklift 900. The left sleeve 200 may be coupled to the left end of the front cross support 210 and to the left end of the rear cross support 215.

The right sleeve 205 may be a straight, hollow tube. The right sleeve 205 may slide onto a right fork 920 of the forklift 900. The right sleeve 205 may be coupled to the right end of the front cross support 210 and to the right end of the rear cross support 215. The right sleeve 205 may comprise a mounting tab 236 projecting from the rear of the right sleeve 205.

The right sleeve 205 may be oriented to be parallel to the left sleeve 200.

In some embodiments, the left sleeve 200 and the right sleeve 205 may have lateral cross-sections that are rectangular. In some embodiments, the length of the right sleeve 205 and the left sleeve 200 as measured from end to end in a longitudinal direction may be at least 20 inches.

The left end of the front cross support 210 may be coupled to the front of the left sleeve 200. The right end of the front cross support 210 may be coupled to the front of the right sleeve 205. The front cross support 210 may retain the left sleeve 200 and the right sleeve 205 at a fixed distance from each other. In some embodiments, the fixed distance that the right sleeve 205 and the left sleeve 200 are separated by may be at least 18 inches.

The center of the front cross support 210 may comprise a chain aperture 222. The chain aperture 222 may prevent the chain 220 from sliding to one side of the front cross support 210 or the other.

The left end of the rear cross support 215 may be coupled to the rear of the left sleeve 200. The right end of the rear cross support 215 may be coupled to the rear of the right sleeve 205. The rear cross support 215 may retain the left sleeve 200 and the right sleeve 205 at a fixed distance from each other. In some embodiments, the fixed distance that the right sleeve 205 and the left sleeve 200 are separated by may be at least 18 inches.

The chain 220 may be a serially connected set of two or more links. The chain 220 may be used to hoist the payload material 950. The top end of the chain 220 may pass through the chain aperture 222 and reverse direction to couple to itself below the front cross support 210. As it doubles back, the chain 220 may pass in front of or behind the front cross support 210. The bottom of the chain 220 may couple to the hook 225.

The hook 225 may be a curved armature for attaching to directly to the payload material 950 or indirectly to the payload material 950 using to a hoist ring 960.

The invention 100 may further comprise a safety latch 230. The safety latch 230 may prevent the right sleeve 205 and the left sleeve 200 from sliding on the forks. A front end of the safety latch 230 may be coupled to the mounting tab 236 located on the rear of the rear cross support 215. A rear end of the safety latch 230 may removably couple to the forklift 900. As a non-limiting example, the rear end of the safety latch 230 may removably couple to a carriage 930 of the forklift 900. In some embodiments, the safety latch 230 may be a horizontally-oriented, bent armature. The front end of the safety latch 230 may comprise a first vertical bend 232. The first vertical bend 232 may hingedly couple to the mounting tab 236. The rear end of the safety latch 230 may comprise a second vertical bend 234 for coupling to the forklift 900.

In use, the invention 100 may be installed onto the forklift 900 by driving the forks of the forklift 900 into the left sleeve 200 and the right sleeve 205 and by coupling the rear end of the safety latch 230 to the carriage 930 of the forklift 900 to prevent sliding. The forks may be raised and the forklift 900 may be positioned such that the payload material 950 is beneath the chain 220. The chain 220 may be coupled to the payload material 950 via the hook 225 either directly or indirectly using the hoist ring 960. The forks may be raised again to lift the payload material 950 and the forklift 900 may be moved to reposition the payload material 950. The forks may be lowered to place the payload material 950 on the ground and the hook 225 may be decoupled from the payload material 950.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "accessory" is a second object that adds to the convenience or attractiveness of a first object. In some instances, an accessory may extend the functionality of the first object by allowing the combination of the accessory plus the first object to perform a task that the first object could not perform alone.

As used in this disclosure, an "aperture" is an opening in a surface. Aperture may be synonymous with hole, slit, crack, gap, slot, or opening.

As used herein, the words "couple", "couples", "coupled" or "coupling", refer to connecting, either directly or indirectly, and does not necessarily imply a mechanical connection.

As used herein, "front" indicates the side of an object that is closest to a forward direction of travel under normal use of the object or the side or part of an object that normally presents itself to view or that is normally used first. "Rear" or "back" refers to the side that is opposite the front.

As used in this disclosure, a "hook" is an object that is curved or bent at an angle such that items can be hung on or caught by the object or such that the object may be suspended from another object.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "lateral" refers to the sides of an object or movement towards a side. Lateral directions are generally perpendicular to longitudinal directions. "Laterally" refers to movement in a lateral direction.

As used herein, the word "longitudinal" or "longitudinally" refers to a lengthwise or longest direction.

As used in this disclosure, a "sleeve" is a tube like covering that is placed over a rod, shaft or other cylindrical object.

As used in this disclosure, a "tab" is an extension of an object for the purpose of facilitating the manipulation of the object, identifying the object, or attaching the object to another object.

As used in this disclosure, a "tube" is a hollow cylindrical device that is used for transporting liquids and/or gases. In this disclosure, the terms inner diameter and outer diameter are used as they would be used by those skilled in the plumbing arts. The line that connects the center of the first base of the cylinder to the center of the second base of the cylinder and is equidistant from the outer surface of the tube for its entire length is referred to as the centerline of the tube. When two tubes share the same centerline they are said to be aligned. When the centerlines of two tubes are perpendicular to each other, the tubes are said to be perpendicular to each other. As used here, "tubing" refers to a tube that is flexible or resilient.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A forklift load-lifting device comprising:

a left sleeve, a right sleeve, a front cross support, a rear cross support, a chain, and a hook;

wherein the forklift load-lifting device is an accessory for a forklift that adapts the forklift to lift a payload material;

wherein the forklift load-lifting device is raised and lowered by forks of the forklift using the left sleeve and the right sleeve;

wherein the payload material is raised and lowered by the chain and the hook as the forklift load-lifting device is raised and lowered;

wherein the left sleeve slides onto a left fork of the forklift;

wherein the right sleeve slides onto a right fork of the forklift;

wherein the left sleeve is coupled to the left end of the front cross support and to the left end of the rear cross support;

wherein the right sleeve is coupled to the right end of the front cross support and to the right end of the rear cross support;

wherein the right sleeve comprises a mounting tab projecting from the rear cross support;

wherein the forklift load-lifting device further comprises a safety latch;

wherein the safety latch prevents the right sleeve and the left sleeve from sliding on the forks;

wherein a front end of the safety latch is coupled to the mounting tab located on the rear of the rear cross support;

wherein a rear end of the safety latch removably couples to the forklift.

2. The forklift load-lifting device according to claim 1 wherein the right sleeve is oriented to be parallel to the left sleeve.

3. The forklift load-lifting device according to claim 2 wherein the left sleeve and the right sleeve have lateral cross-sections that are rectangular.

4. The forklift load-lifting device according to claim 3 wherein the left end of the front cross support is coupled to the front of the left sleeve;

wherein the right end of the front cross support is coupled to the front of the right sleeve;

wherein the front cross support retains the left sleeve and the right sleeve at a fixed distance from each other.

5. The forklift load-lifting device according to claim 4 wherein the center of the front cross support comprises a chain aperture;

wherein the chain aperture prevents the chain from sliding to one side of the front cross support or the other.

6. The forklift load-lifting device according to claim 5 wherein the left end of the rear cross support is coupled to the rear of the left sleeve;

wherein the right end of the rear cross support is coupled to the rear of the right sleeve;

wherein the rear cross support retains the left sleeve and the right sleeve at a fixed distance from each other.

7. The forklift load-lifting device according to claim 6 wherein the length of the right sleeve and the left sleeve as measured from end to end in a longitudinal direction is at least 20 inches;

wherein the fixed distance that the right sleeve and the left sleeve are separated by is at least 18 inches.

8. The forklift load-lifting device according to claim 6 wherein the chain is a serially connected set of two or more links;

wherein the chain is used to hoist the payload material.

9. The forklift load-lifting device according to claim 8 wherein the top end of the chain passes through the chain aperture and reverse direction to couple to itself below the front cross support;

wherein the chain passes in front of or behind the front cross support as it doubles back.

10. The forklift load-lifting device according to claim 9 wherein the bottom of the chain couples to the hook.

11. The forklift load-lifting device according to claim 10 wherein the hook is a curved armature for attaching to directly to the payload material or indirectly to the payload material using to a hoist ring.

12. The forklift load-lifting device according to claim 11 wherein the safety latch is a horizontally-oriented, bent armature.

13. The forklift load-lifting device according to claim 12 wherein the front end of the safety latch comprises a first vertical bend;

wherein the first vertical bend hingedly couples to the mounting tab;

wherein the rear end of the safety latch comprises a second vertical bend for coupling to the forklift.

* * * * *